US010660441B2

(12) United States Patent
Ma et al.

(10) Patent No.: US 10,660,441 B2
(45) Date of Patent: May 26, 2020

(54) INTEGRATED CHAIR FRAME MOTOR TRANSMISSION ASSEMBLY

(71) Applicant: TAIZHOU LUCKY PRETTY MACHINERY Co.,Ltd., Taizhou (CN)

(72) Inventors: Mingyang Ma, Taizhou (CN); Yifeng Chen, Taizhou (CN); Shaoyu Ma, Taizhou (CN)

(73) Assignee: TAIZHOU LUCKY PRETTY MACHINERY CO., LTD., Taizhou (CN)

( * ) Notice: Subject to any disclaimer, the term of this patent is extended or adjusted under 35 U.S.C. 154(b) by 48 days.

(21) Appl. No.: 15/851,751

(22) Filed: Dec. 22, 2017

(65) Prior Publication Data

US 2018/0303238 A1 Oct. 25, 2018

(30) Foreign Application Priority Data

Apr. 20, 2017 (CN) ..... 2017 1 0272211

(51) Int. Cl.
*A47C 1/024* (2006.01)
*A47C 1/034* (2006.01)
*A47C 7/46* (2006.01)

(52) U.S. Cl.
CPC ..... *A47C 1/0242* (2013.01); *A47C 1/034* (2013.01); *A47C 7/462* (2013.01)

(58) Field of Classification Search
CPC ..... A47C 1/0242; A47C 7/462
See application file for complete search history.

(56) References Cited

U.S. PATENT DOCUMENTS 4,678,230 A * 7/1987 Winkle ..... A47C 7/462 297/284.4
4,896,918 A * 1/1990 Hoshihara ..... A47C 7/462 297/284.4
4,981,325 A * 1/1991 Zacharkow ..... A47C 7/405 297/230.14
5,088,790 A * 2/1992 Wainwright ..... B60N 2/66 297/284.4
5,286,087 A * 2/1994 Elton ..... B60N 2/66 297/284.1
5,466,045 A * 11/1995 Akima ..... A47C 7/462 297/284.4
5,553,919 A * 9/1996 Dennis ..... A47C 7/462 297/284.8

(Continued)

*Primary Examiner* — David R Dunn
*Assistant Examiner* — Christopher E Veraa
(74) *Attorney, Agent, or Firm* — Bayramoglu Law Offices LLC

(57) ABSTRACT

This invention provides an integrated chair frame motor transmission assembly for adjusting the position of a chair backrest bracket, including a bracket. A fixing part fixed to the chair frame is arranged at an upper end and a lower end of the bracket. A motor speed reducing module is fixed to the bracket, and one end of a screw rod is connected to the motor speed reducing module. The other end of the screw rod is connected to a fixing block, and the fixing block is fixed to the bracket. A sliding groove is formed in the bracket, and a sliding block is arranged corresponding to the sliding groove. The screw rod is matched with and connected to the sliding block and drives the sliding block to move back and forth along the sliding groove.

18 Claims, 6 Drawing Sheets

(56) References Cited

U.S. PATENT DOCUMENTS

| | | | | |
|---|---|---|---|---|
| 5,567,010 | A * | 10/1996 | Sparks | A47C 7/462 297/284.1 |
| 6,409,262 | B1 * | 6/2002 | LaPointe | A47C 1/0352 297/452.18 |
| 2009/0079245 | A1 * | 3/2009 | Marcantoni | A47C 7/465 297/284.4 |
| 2012/0068508 | A1 * | 3/2012 | LaPointe | A47C 7/462 297/284.8 |
| 2014/0346827 | A1 * | 11/2014 | Suzuki | A47C 7/462 297/284.7 |
| 2016/0367033 | A1 * | 12/2016 | Sigmon | A47C 1/02 |
| 2017/0181549 | A1 * | 6/2017 | Donovan | B60N 2/66 |

* cited by examiner

INTEGRATED CHAIR FRAME MOTOR TRANSMISSION ASSEMBLY

CROSS REFERENCE TO RELATED APPLICATIONS

This application is based upon and claims priority to Chinese Patent Application No. CN2017102722114, filed on Apr. 24, 2017, the entire content of which is incorporated herein by reference.

TECHNICAL FIELD

The invention relates to the technical field of electromechanical integration, particularly to an integrated chair frame motor transmission assembly which can be applied to the position adjustment of a chair backrest bracket.

BACKGROUND OF THE INVENTION

The existing chairs can be categorized as an office chair, a household chair and most of the multifunctional chairs. Apart from ensuring the strength and stability of the chair, the comfort level and the health of a human body are also emphasized while designing a chair. Particularly, as to the design of the backrest of the chair, the protection of the lumbar vertebra and the spine of the human body needs to be taken into consideration. Therefore, the chair backrest can be specially designed, for example, a motor transmission assembly is designed on the backrest chair frame, to allow the user to adjust the backrest according to the requirements of the user, so that the comfort level can be improved while the waist and the back of the human body can be protected.

Referring to the chair frame of the existing multifunctional chair shown in FIG. 1, which can be unfolded as a deck chair or a massage chair, and the multifunctional chair can also move upward and downward to work as a general office or household chair after being retracted. A plurality of use requirements can be met for people, and therefore, the multifunctional chair is preferred by a great number of users. The chair frame of the multifunctional chair generally includes a seat part, a backrest part and a pedal part which can be unfolded or retracted. Currently, a motor transmission mechanism is installed at the lower part of the chair frame of the seat part, so that the position of the backrest part can be adjusted by the action of backrest part.

According to the invention, the adjusting action of the backrest bracket 100 is realized by installing a motor transmission mechanism 10 at the bottom of the chair frame. The motor transmission mechanism 10 includes a fixing part 12 connected to a connecting plate 110 of the backrest bracket 100, a motor speed reducing module 14, a screw rod transmission module 15 connected to the speed reducing module 14, an ejector rod 16 connected to the screw rod transmission module 15, and a connecting structure 18 fixed to the chair frame component arranged at the end part of the ejector rod 16. According to the motor transmission mechanism, the screw rod transmission mechanism is used for driving the ejector rod 16 to reciprocate to achieve the movements of the chair frame related part. An installation space and a movement space of a long distance are required to guarantee the normal work of the motor transmission mechanism. In addition, the fixed part 12 at the top and the connecting plate 110, and the connecting structure 18 at the top end of the ejector rod 16 and the chair frame component, are both connected and fixed by adopting a rivet point connection mode. Hence, the stability of the movement of the backrest and the stability of the whole chair after adjusting the backrest are influenced, and the backrest is relatively easy to shake. Particularly, when the weight of a person on the chair is too large, the ejection rod of the motor transmission mechanism can be easily deformed due to frequent shaking. Therefore, it is necessary to provide a motor transmission mechanism which is simple in structure and higher in operation process and supporting stability. Meanwhile, the installation space of the chair also needs to be taken into consideration.

SUMMARY OF THE INVENTION

In view of the defects in the prior art, the invention aims to provide an integrated chair frame motor transmission assembly with a simple structure, high action and supporting stabilities and a low cost, and this motor transmission assembly is suitable for the backrest position adjustments of various chairs.

To achieve the objectives of the invention, the invention provides an integrated chair frame motor transmission assembly, including a bracket, wherein a fixing part fixed to the chair frame is arranged at an upper end and a lower end of the bracket. A motor speed reducing module is fixed to the bracket, and one end of a screw rod is connected to the motor speed reducing module, the other end of the screw rod is connected to a fixing block, and the fixing block is fixed to the bracket. A sliding groove is formed in the bracket, and a sliding block is arranged corresponding to the sliding groove, the screw rod is matched with and connected to the sliding block and drives the sliding block to move back and forth along the sliding groove. A first connecting rod is connected to the sliding block and a second connecting rod, one end of the second connecting rod is connected to the bracket, and the other end of the second connecting rod is connected to a first connecting portion on a fixed connecting plate, and the fixed connecting plate is fixed to a backrest bracket of the chair frame.

Preferably, the motor speed reducing module is a turbine and worm speed reducing module or a gear speed reducing module.

Preferably, one end of the first connecting rod is connected to the sliding block, the middle of the first connecting rod is connected to the middle of the second connecting rod, and the other end of the first connecting rod is connected to a second connecting portion on the fixed connecting plate. A groove is provided on the fixed connecting plate, and the second connecting portion slides along the groove.

Preferably, the first connecting rod and the sliding block, the first connecting rod and the second connecting rod, the second connecting rod and the bracket, the second connecting rod and a first connecting part on the first connecting plate, are all connected through pin shafts or rivets respectively.

Preferably, the motor transmission assembly further includes a rear cover.

Preferably, the first connecting rod and the second connecting rod of the motor transmission assembly are arranged in pairs.

Preferably, a rivet is also arranged at one end of the second connecting portion, and when the fixed connecting plate reaches a highest position, the rivet abuts against the first connecting portion of the fixed connecting plate.

Preferably, a rivet is also arranged at one end of the first connecting rod where the first connecting rod is connected to the second connecting portion of the fixed connecting plate, and when the fixed connecting plate reaches the highest position, the rivet abuts against the second connecting portion of the fixed connecting plate.

Preferably, when the fixed connecting plate reaches the highest position, a vertical portion of the fixed connecting plate is parallel to the sliding groove.

As to the integrated chair frame motor transmission assembly of the present invention, the connecting rod mechanism is directly connected to the screw rod of the motor, to simplify the structure of the whole assembly and reduce the manufacturing cost of the whole assembly. The fixed connecting plate is driven by the connecting rod mechanism to drive the chair frame backrest bracket connected to the fixed connecting plate to move, and the backrest bracket is in surface contact with the fixed connecting plate, so that the movement of the backrest and the stability of the chair are greatly improved, while the service life of the motor transmission assembly is prolonged.

BRIEF DESCRIPTION OF THE DRAWINGS

The foregoing and other objectives, features, and advantages of the present invention will become apparent, from the following detailed description with reference to the accompanying drawings, in which.

DETAILED DESCRIPTION OF THE INVENTION

The structural features and advantages of the present invention are described in detail with reference to the drawings.

Figure 1:
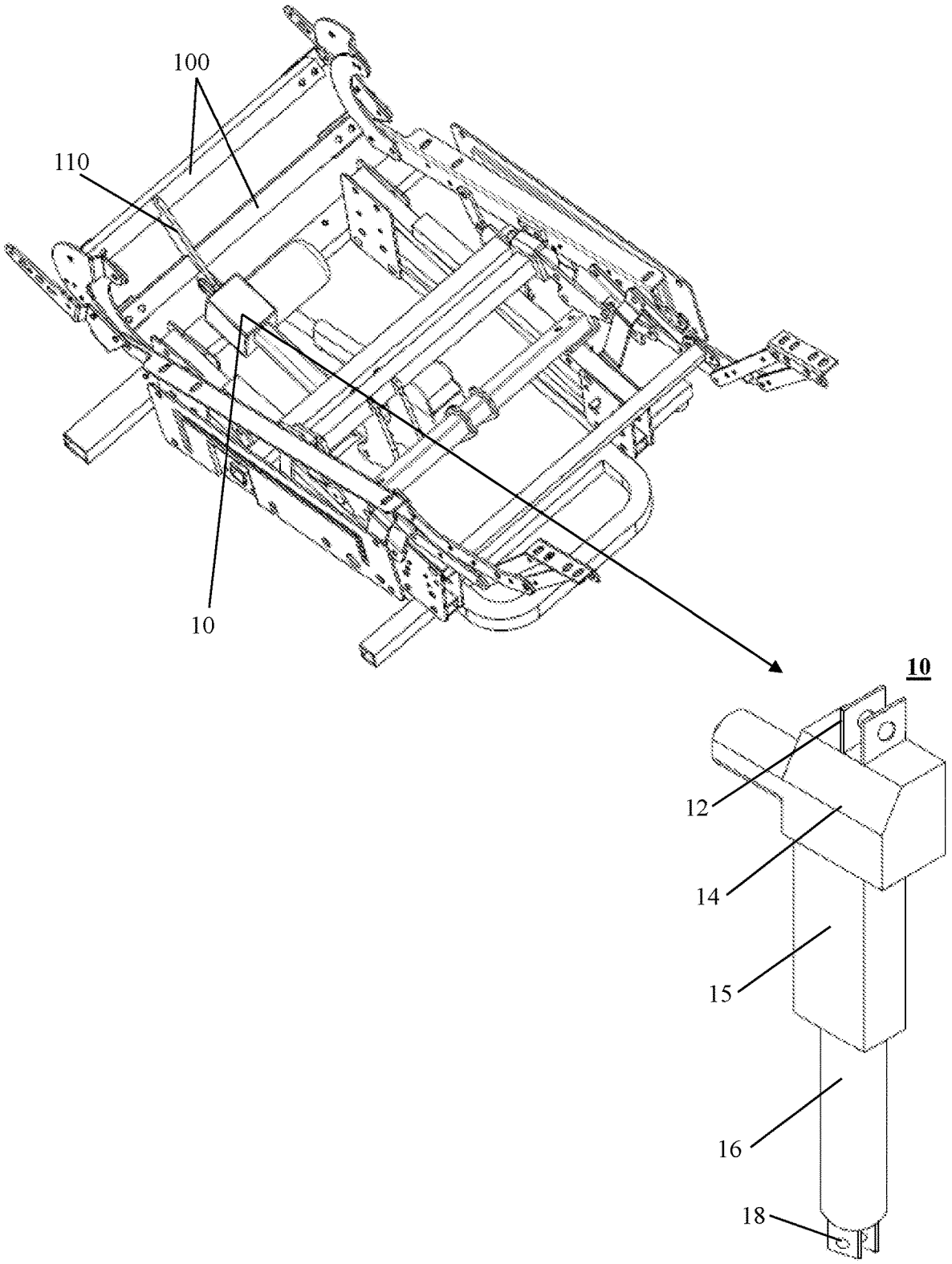
FIG. 1 is a schematic structural diagram of a multifunctional chair frame and a motor transmission mechanism thereof in the prior art.
Figure 2:
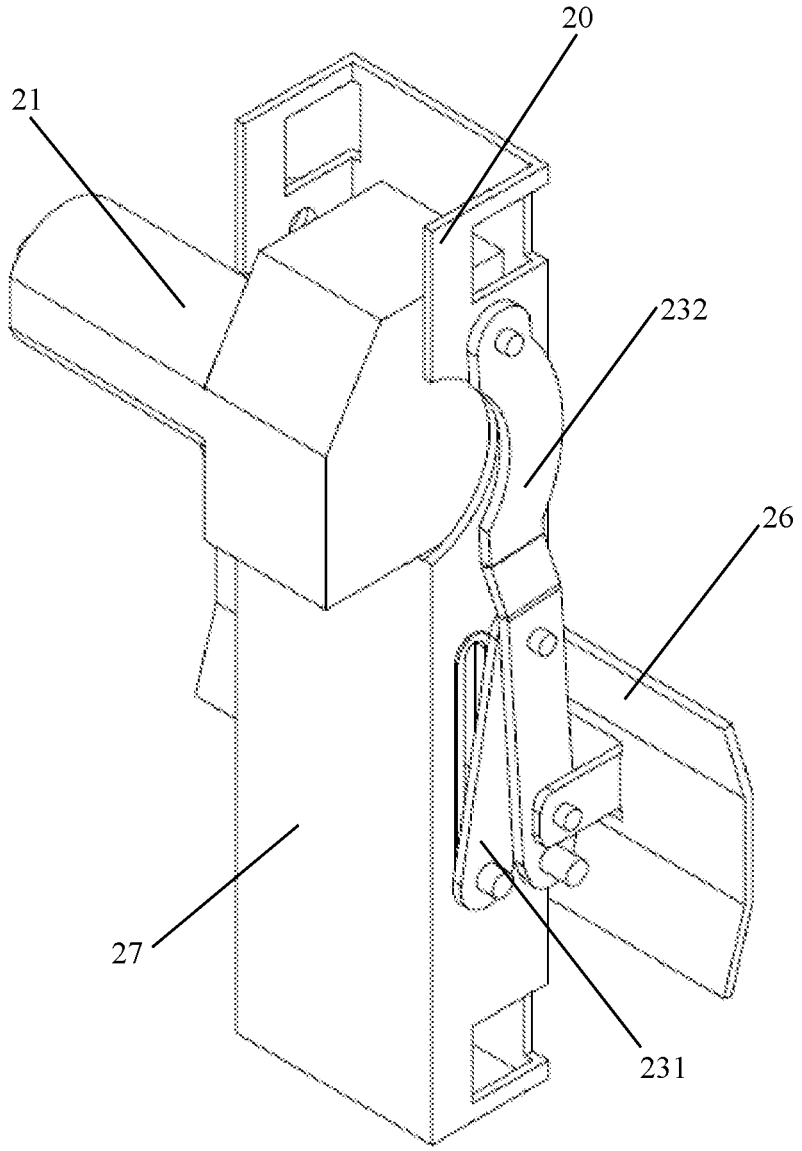
FIG. 2 is a schematic structural diagram of an integrated chair frame motor transmission assembly according to an embodiment of the present invention.
Figure 3:
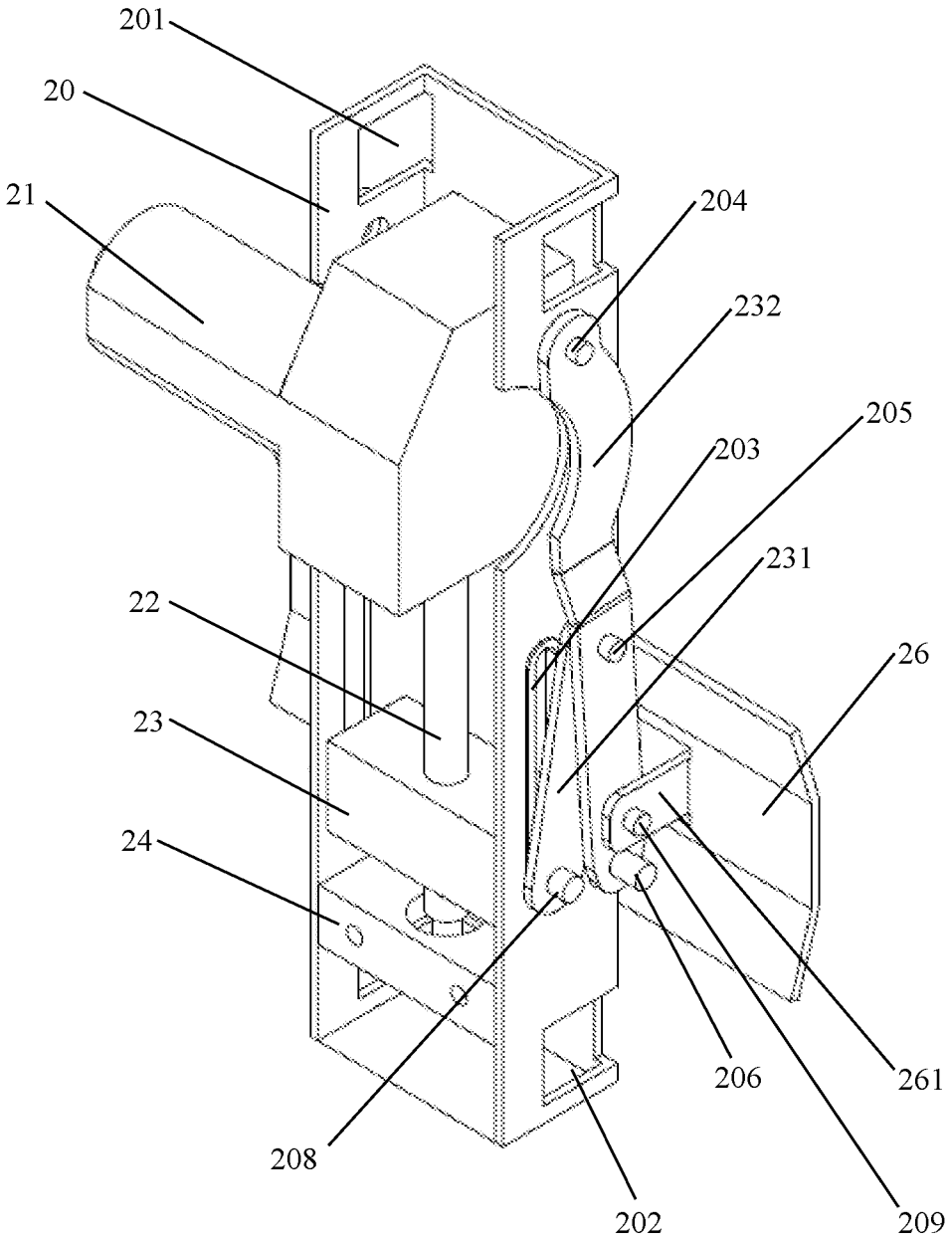
FIG. 3 is a structural schematic diagram of the motor transmission assembly of FIG. 2 (a rear cover removed)
Figure 3A:
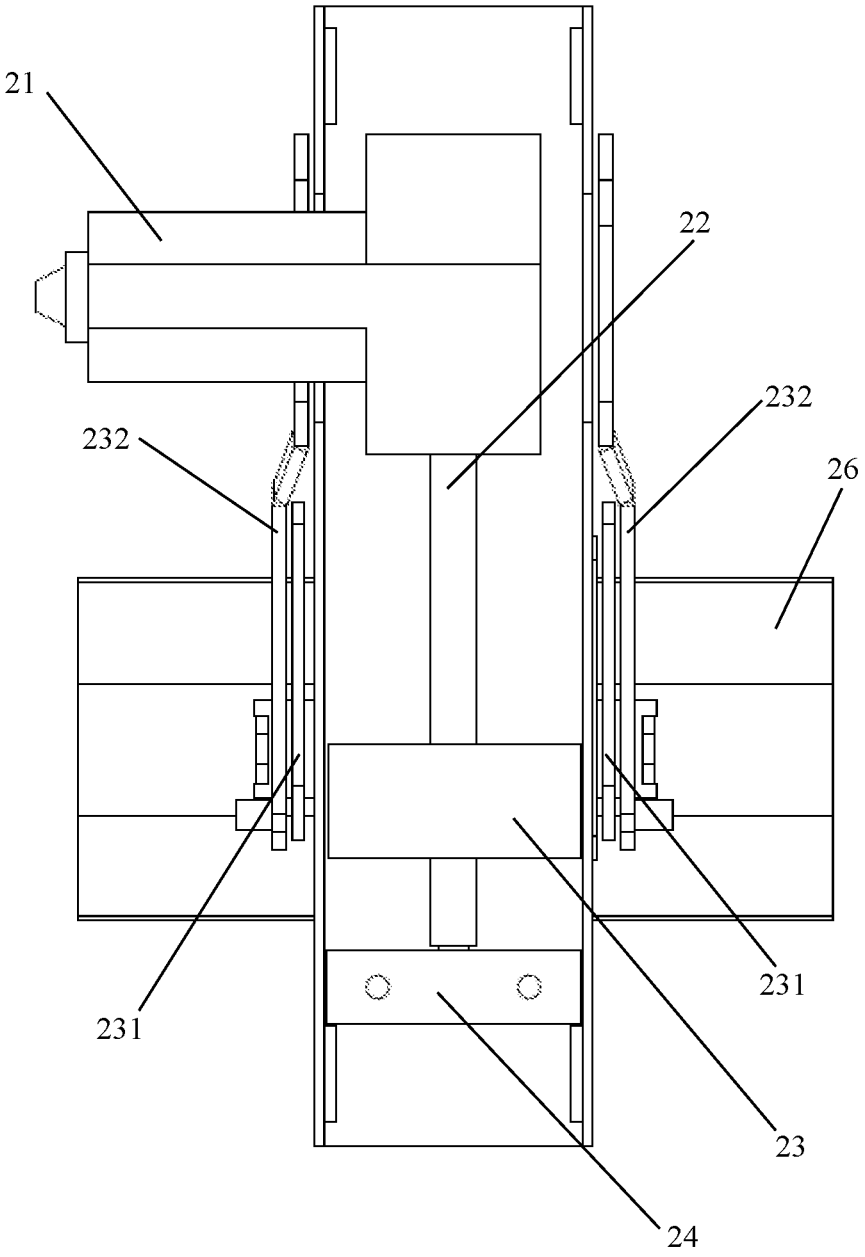
FIG. 3A is a schematic structural diagram of a front view of the motor transmission assembly of FIG. 3.

Referring to FIGS. 2, 3 and 3A, the present invention provides an integrated chair frame motor transmission assembly which is suitable for adjustment of chair backrest position. The motor transmission assembly includes a bracket 20. A fixing part 201 and a fixing part 202, which are fixed to the chair frame, are arranged at an upper end and a lower end of the bracket 20. A fixed square hole is formed in each of the fixed portion 201 and the fixed portion 202. The motor speed reducing module 21 is fixed to the bracket, and one end of the screw rod 22 is connected to the motor speed reducing module 21, the other end of the screw rod 22 is connected to the fixing block 24, and the fixing block 24 is fixed to the bracket 20. A sliding groove 203 is formed in the bracket 20, and the sliding block 23 is arranged corresponding to the sliding groove 203. The screw rod 22 is connected to the sliding block 23 and drives the sliding block 23 to move back and forth along the sliding groove 203. One end of the first connecting rod 231 is connected to the sliding block 23, the other end of the first connecting rod 231 is connected to the middle of the second connecting rod 232. One end of the second connecting rod 232 is connected to the bracket 20, and the other end of the second connecting rod 232 is connected to the first connecting portion 261 on the fixed connecting plate 26. The fixed connecting plate 26 is fixed to the chair frame component, such as a backrest bracket.

While using the chair, if user needs to adjust the position of the backrest, the motor transmission assembly is started through the control switch. The motor speed reducing module 21 drives the screw rod 22 to operate, and the screw rod 22 drives the sliding block 23 matched with the screw rod 22 to move along the sliding groove 203. The first connecting rod 231 and the second connecting rod 232 connected to the first connecting rod 231 are then driven to move, and finally the backrest bracket fixed to the fixed connecting plate 26 is driven to move by the fixed connecting plate 26 connected to the end of the second connecting rod 232, so as to adjust the backrest of the chair to a proper position. Wherein, the motor speed reducing module 21 can be a turbine and worm speed reducing module or a gear speed reducing module.

In the above embodiment, the first connecting rod 231 and the sliding block 23, the first connecting rod 231 and the middle of the second connecting rod 232, the second connecting rod 232 and the bracket 20, the second connecting rod 232 and the first connecting part 261 on the fixed connecting plate 26, are all connected through pin shafts or rivets 208, 205, 204 and 209 respectively.

Referring to FIG. 3, in a preferred embodiment, the motor transmission assembly further includes a rear cover 27.

Referring to FIG. 3A, in another preferred embodiment, the first connecting rod 231 and the second connecting rod 232 of the motor transmission assembly are arranged in pairs.

Figure 4:
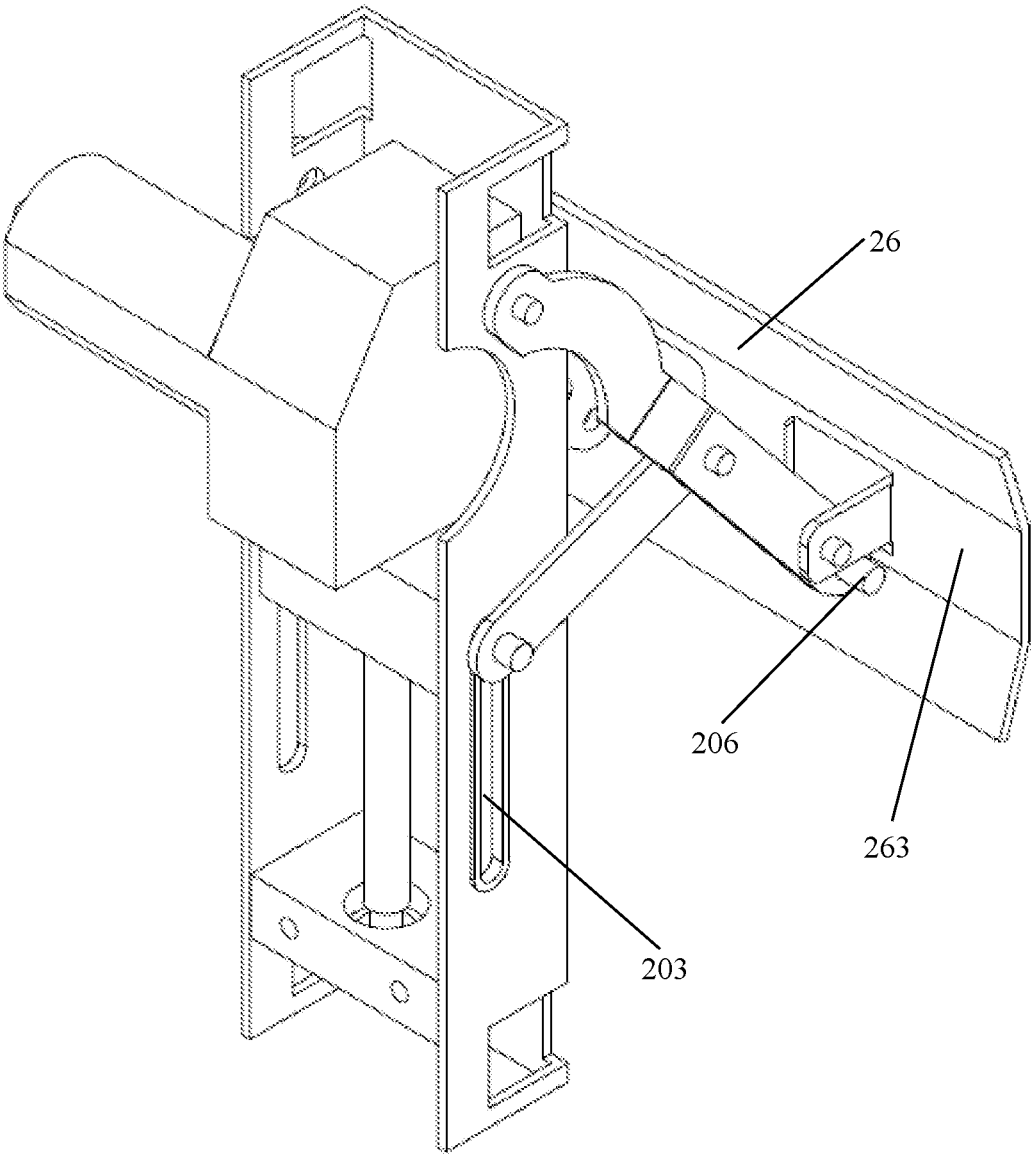
FIG. 4 is a schematic structural diagram of the extending state of the motor transmission assembly of FIG. 3.

Referring to the structural schematic diagram of the stretching state of the motor transmission assembly as shown in FIG. 4, in order to improve the supporting stability and the bearing capacity of the connecting plate 26 when the connecting rod driving mechanism (the first connecting rod 231 and the second connecting rod 232) of the motor transmission assembly moves to the uppermost position (that is, when the fixed connecting plate reaches the highest position) are fixed, and avoid the rotation of the fixed connecting plate 26, in a preferred embodiment, a rivet 206 is arranged at the end of the second connecting rod. When the connecting rod driving mechanism moves to the highest position, the rivet 206 abuts against the first connecting portion 261 of the fixing connecting plate 26. Preferably, in this working state, the vertical portion 263 of the fixed connecting plate 26 is parallel to the sliding groove 203.

Figure 5:
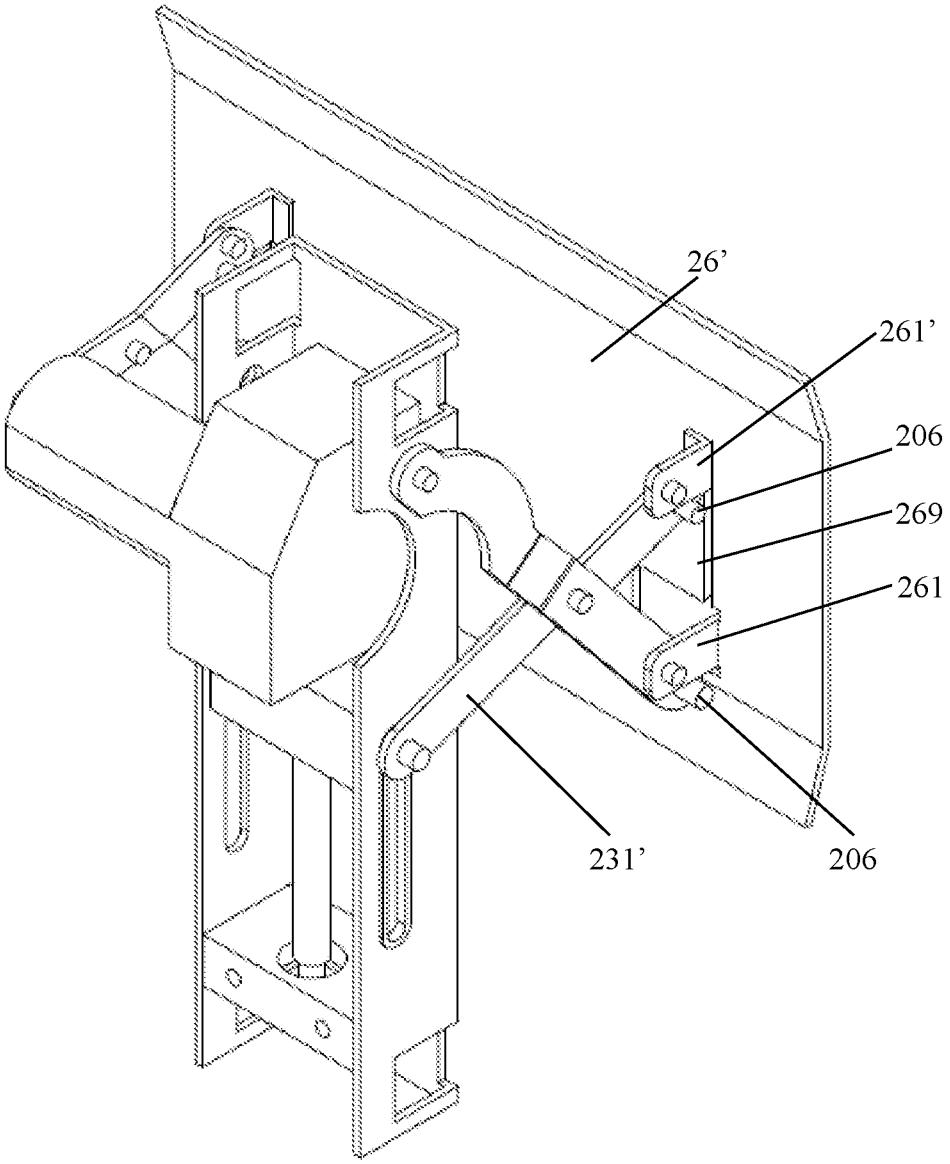
FIG. 5 is a schematic structural diagram of an integrated chair frame motor transmission assembly according to another embodiment of the present invention.

Referring to FIG. 5, in a more preferable embodiment, the first connecting rod 231' and the second connecting rod 232 of the motor transmission assembly are arranged in a scissor-shaped structure. Namely one end of the first connecting rod 231' is connected to the sliding block 23, the middle of the first connecting rod 231' is connected to the middle of the second connecting rod 232, and the other end of the first connecting rod 231' is connected to a second connecting portion 261' on the fixed connecting plate 26'. The second connecting portion 261' can slide along the groove 269 on the fixed connecting plate. In this way, the double-connecting-rod driving and supporting structure is provided to make the action more stable and thus increasing the stability of the chair backrest. Likewise, in order to improve the stability of the fixed connecting plate 26' when the connecting rod mechanism is located at the highest point, a rivet 206 is also arranged at one end of the first connecting rod 231' where the first connecting rod 231' is connected to the second connecting portion 261'. When the connecting rod mechanism is located at the highest point, the rivet 206 abuts against the second connecting portion 261'.

Figure 5A:
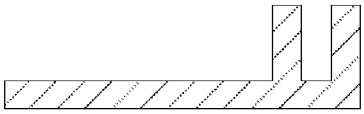
FIG. 5A is a schematic structural diagram of a cross section of a second connecting part on a fixed connecting plate of the motor transmission assembly of FIG. 5.
Figure 5B:
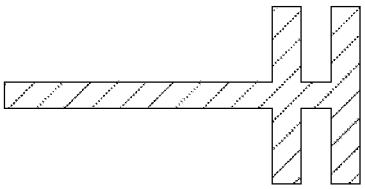
FIG. 5B is a schematic structural diagram of another cross section of a second connecting part on a fixed connecting plate of the motor transmission assembly of FIG. 5.

Referring to the cross-sectional schematic diagrams of the two structures of the second connecting part 261' as shown in FIGS. 5A and 5B, the structure matched with the groove 269 can be F-shaped or I-shaped.

According to the integrated chair frame motor transmission assembly, the connecting rod driving mechanism is directly connected to the screw rod of the motor, so as to simplify the structure of the whole assembly, reduce the manufacturing cost, and save the action space of the assembly. A connecting rod mechanism is used for driving the fixed connecting plate to drive a chair frame component, such as a backrest bracket, connected to the fixed connecting plate to move. The chair frame component is in surface contact with the fixed connecting plate, and the connecting rod mechanisms are arranged in pairs. Hence, the stability of movement and the stability of the backrest are greatly improved while the service life of the motor transmission assembly is prolonged.

The invention is not limited to the embodiments, and the technical personnel in the field can still make some modifications or changes, without departing from the spirit and the scope of the invention. The scope of the present invention is defined by the appended claims.

We claim:

1. An integrated chair frame motor transmission assembly, comprising:

a bracket;

a fixing part fixed to a chair frame, wherein the fixing part is arranged at an upper end and a lower end of the bracket;

a motor speed reducing module fixed to the bracket, wherein a first end of a screw rod is connected to the motor speed reducing module, a second end of the screw rod is connected to a fixing block, and the fixing block is fixed to the bracket, wherein a sliding groove is formed in the bracket, and a sliding block is arranged corresponding to the sliding groove, the screw rod is matched with and connected to the sliding block and drives the sliding block to move vertically along the sliding groove, wherein a first connecting rod is connected to the sliding block and a middle of a second connecting rod, a first end of the second connecting rod is connected to the bracket, and a second end of the second connecting rod is connected to a first connecting part on a fixed connecting plate, and the fixed connecting plate is fixed to a backrest bracket of the chair frame.

2. The integrated chair frame motor transmission assembly of claim 1, wherein the motor speed reducing module is a turbine and worm speed reducing module or a gear speed reducing module.

3. The integrated chair frame motor transmission assembly of claim 2, wherein a first end of the first connecting rod is connected to the sliding block, the middle of the first connecting rod is connected to the middle of the second connecting rod, and a second end of the first connecting rod is connected to a second connecting portion on the fixed connecting plate, wherein a groove is provided on the fixed connecting plate, and the second connecting portion slides along the groove.

4. The integrated chair frame motor transmission assembly of claim 3, wherein the first connecting rod and the sliding block are connected through a pin shaft or a rivet, the first connecting rod and the second connecting rod are connected through a pin shaft or a rivet, the second connecting rod and the bracket are connected through a pin shaft or a rivet, the second connecting rod and a first connecting part on the first connecting plate are connected through a pin shaft or a rivet.

5. The integrated chair frame motor transmission assembly of claim 3, wherein the motor transmission assembly further includes a rear cover.

6. The integrated chair frame motor transmission assembly of claim 3, wherein the first connecting rod and the second connecting rod of the motor transmission assembly are arranged in pairs.

7. The integrated chair frame motor transmission assembly of claim 3, wherein a rivet is arranged at one end of the second connecting portion, and when the fixed connecting plate reaches a highest position, the rivet abuts against the first connecting part of the fixed connecting plate.

8. The integrated chair frame motor transmission assembly of claim 7, wherein when the fixed connecting plate reaches the highest position, a vertical portion of the fixed connecting plate is parallel to the sliding groove.

9. The integrated chair frame motor transmission assembly of claim 3, wherein a rivet is arranged at the first end of the first connecting rod where the first connecting rod is connected to the second connecting portion of the fixed connecting plate, and when the fixed connecting plate reaches a highest position, the rivet abuts against the second connecting portion of the fixed connecting plate.

10. The integrated chair frame motor transmission assembly of claim 9, wherein when the fixed connecting plate reaches the highest position, a vertical portion of the fixed connecting plate is parallel to the sliding groove.

11. The integrated chair frame motor transmission assembly of claim 1, wherein a first end of the first connecting rod is connected to the sliding block, the middle of the first connecting rod is connected to the middle of the second connecting rod, and a second end of the first connecting rod is connected to a second connecting portion on the fixed connecting plate, wherein a groove is provided on the fixed connecting plate, and the second connecting portion slides along the groove.

12. The integrated chair frame motor transmission assembly of claim 11, wherein the first connecting rod and the sliding block are connected through a pin shaft or a rivet, the first connecting rod and the second connecting rod are connected through a pin shaft or a rivet, the second connecting rod and the bracket are connected through a pin shaft or a rivet, the second connecting rod and a first connecting part on the first connecting plate are connected through a pin shaft or a rivet.

13. The integrated chair frame motor transmission assembly of claim 11, wherein the motor transmission assembly further includes a rear cover.

14. The integrated chair frame motor transmission assembly of claim 11, wherein the first connecting rod and the second connecting rod of the motor transmission assembly are arranged in pairs.

15. The integrated chair frame motor transmission assembly of claim 11, wherein a rivet is arranged at one end of the second connecting portion, and when the fixed connecting plate reaches a highest position, the rivet abuts against the first connecting part of the fixed connecting plate.

16. The integrated chair frame motor transmission assembly of claim 15, wherein when the fixed connecting plate reaches the highest position, a vertical portion of the fixed connecting plate is parallel to the sliding groove.

17. The integrated chair frame motor transmission assembly of claim 11, wherein a rivet is arranged at the first end of the first connecting rod where the first connecting rod is connected to the second connecting portion of the fixed connecting plate, and when the fixed connecting plate reaches a highest position, the rivet abuts against the second connecting portion of the fixed connecting plate.

18. The integrated chair frame motor transmission assembly of claim 17, wherein when the fixed connecting plate reaches the highest position, a vertical portion of the fixed connecting plate is parallel to the sliding groove.

* * * * *